US009818415B2

(12) United States Patent
Nurmukhanov et al.

(10) Patent No.: US 9,818,415 B2
(45) Date of Patent: Nov. 14, 2017

(54) SELECTIVE WATERMARKING OF CHANNELS OF MULTICHANNEL AUDIO

(71) Applicant: DOLBY LABORATORIES LICENSING CORPORATION, San Francisco, CA (US)

(72) Inventors: Dossym Nurmukhanov, South San Francisco, CA (US); Sripal S. Mehta, San Francisco, CA (US); Dirk Jeroen Breebaart, Pyrmont (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 14/916,029

(22) PCT Filed: Sep. 9, 2014

(86) PCT No.: PCT/US2014/054833
§ 371 (c)(1),
(2) Date: Mar. 2, 2016

(87) PCT Pub. No.: WO2015/038546
PCT Pub. Date: Mar. 19, 2015

(65) Prior Publication Data

US 2016/0210972 A1 Jul. 21, 2016

Related U.S. Application Data

(60) Provisional application No. 61/877,139, filed on Sep. 12, 2013.

(51) Int. Cl.

| | |
|---|---|
| ***H04R 5/00*** | (2006.01) |
| ***G10L 19/018*** | (2013.01) |
| ***G10L 19/008*** | (2013.01) |

(52) U.S. Cl.
CPC ..... *G10L 19/018* (2013.01); *G10L 19/008* (2013.01)

(58) Field of Classification Search
CPC ..... G10L 19/018; G10L 19/008
(Continued)

(56) References Cited

U.S. PATENT DOCUMENTS

| | | | |
|---|---|---|---|
| 5,945,932 | A | 8/1999 | Smith |
| 7,206,649 | B2 | 4/2007 | Kirovski |

(Continued)

FOREIGN PATENT DOCUMENTS

| | | |
|---|---|---|
| EP | 1739618 | 1/2007 |
| EP | 2562748 | 2/2013 |

(Continued)

OTHER PUBLICATIONS

Stanojevic, T. "Some Technical Possibilities of Using the Total Surround Sound Concept in the Motion Picture Technology", 133rd SMPTE Technical Conference and Equipment Exhibit, Los Angeles Convention Center, Los Angeles, California, Oct. 26-29, 1991, 3 pages.

(Continued)

*Primary Examiner* — Thjuan K Addy

(57) ABSTRACT

A method for selecting a subset of channels of (e.g., determined from) at least a segment of a multichannel audio program for watermarking and watermarking the selected subset of channels, and a system or device configured to implement any embodiment of the method, or including a buffer which stores at least one frame or other segment of a multichannel audio program generated by any embodiment of the method or steps thereof. Some embodiments generate watermarking metadata during program creation including by analyzing audio content to be included in segments of a multichannel program, determining at least one watermark (Continued)

suitability value for each channel of each of the segments, and including the watermark suitability values (or watermarking data determined therefrom) as metadata in the program. Some embodiments are implemented by a playback system which determines the selected subset of channels to be watermarked.

20 Claims, 4 Drawing Sheets

(58) Field of Classification Search
USPC ..... 381/22, 17, 23
See application file for complete search history.

(56) References Cited

U.S. PATENT DOCUMENTS

| | | | | |
|---|---|---|---|---|
| 7,920,713 | B2 | 4/2011 | Wells | |
| 8,280,103 | B2 | 10/2012 | Petrovic | |
| 9,093,064 | B2 * | 7/2015 | Srinivasan | G10L 19/008 |
| 2006/0133644 | A1 | 6/2006 | Wells | |
| 2013/0051564 | A1 | 2/2013 | Baum | |
| 2013/0218314 | A1 | 8/2013 | Wabnik | |
| 2015/0317988 | A1 * | 11/2015 | Srinivasan | G10L 19/008 381/23 |

FOREIGN PATENT DOCUMENTS

| | | |
|---|---|---|
| JP | 2004-039240 | 2/2004 |
| RS | 1332 U | 8/2013 |
| WO | 2011/119401 | 9/2011 |

OTHER PUBLICATIONS

Stanojevic, T. et al "Designing of TSS Halls" 13th International Congress on Acoustics, Yugoslavia, 1989, pp. 326-331.
Stanojevic, T. et al "The Total Surround Sound (TSS) Processor" SMPTE Journal, Nov. 1994, pp. 734-740.
Stanojevic, T. et al "The Total Surround Sound System", 86th AES Convention, Hamburg, Mar. 7-10, 1989, 21 pages.
Stanojevic, T. et al "TSS System and Live Performance Sound" 88th AES Convention, Montreux, Mar. 13-16, 1990, pp. 1-27.
Stanojevic, T. et al. "TSS Processor" 135th SMPTE Technical Conference, Oct. 29-Nov. 2, 1993, Los Angeles Convention Center, Los Angeles, California, Society of Motion Picture and Television Engineers, pp. 1-22.
Stanojevic, Tomislav "3-D Sound in Future HDTV Projection Systems" presented at the 132nd SMPTE Technical Conference, Jacob K. Javits Convention Center, New York City, Oct. 13-17, 1990, pp. 1-20.
Stanojevic, Tomislav "Surround Sound for a New Generation of Theaters, Sound and Video Contractor" Dec. 20, 1995, pp. 1-7.
Stanojevic, Tomislav, "Virtual Sound Sources in the Total Surround Sound System" Proc. 137th SMPTE Technical Conference and World Media Expo, Sep. 6-9, 1995, New Orleans Convention Center, New Orleans, Louisiana, pp. 405-421.
Murata, H. et al. "Multichannel Audio Watermarking Method by Multiple Embedding" International Symposium on Information Theory and its Applications, ISITA2008, Auckland, New Zealand, Dec. 7-10, 2008.

* cited by examiner

SELECTIVE WATERMARKING OF CHANNELS OF MULTICHANNEL AUDIO

CROSS REFERENCE TO RELATED APPLICATIONS

This application claims priority to U.S. Provisional Patent Application No. 61/877,139, filed on 12 Sep. 2013, which is hereby incorporated by reference in its entirety.

TECHNICAL FIELD

The invention pertains to audio signal processing, and more particularly to watermarking of selected channels of multichannel audio programs (e.g., bitstreams indicative of object-based audio programs including at least one audio object channel and at least one speaker channel).

BACKGROUND

Watermarking (forensic marking) is employed in digital cinemas to prevent piracy and allow forensic tracking of illicit captures or copies of cinematic content, and is also employed in other contexts. Watermarks, which can be embedded in both audio and video signals, should be robust against legitimate and illegitimate modifications to the marked content and captures of the marked content (e.g., captures made by mobile phones or high-quality audio and video recording devices). Watermarks typically comprise information about when and where playback of the content has occurred. Thus, watermarking for theatrical use typically occurs during actual playback, and the watermarks to content played in theaters are typically indicative of theater identification data (a theater "ID") and playback time.

The complexity, and therefore the financial and computational cost, of watermarking audio programs increases linearly with the number of channels to be watermarked. During rendering and playback (e.g., in movie theaters) of object based audio programs, the audio content has a number of channels (e.g., object channels and speaker channels) which is typically much larger (e.g., by an order of magnitude) than the number occurring during rendering and playback of conventional speaker-channel based programs. Typically also, the speaker system used for playback includes a much larger number of speakers than the number employed for playback of conventional speaker-channel based programs.

It is conventional to watermark some but not all speaker channels of a multichannel audio program of the conventional type comprising speaker channels but not object channels. However, conventional watermarking of this type does not measure content of individual channels of the program to select which channels should be watermarked, and does not select which channels to watermark based on the configuration of the playback speakers (e.g., the arrangement of speakers in a room) or the audio content to be played by any of the speakers. Rather, conventional watermarking of this type typically tries to watermark the first N channels of the program (where N is a small number consistent with the processing limitations of the watermarking system, e.g., N=8) or all the channels if the program comprises not more than a small number of channels, but during watermarking (e.g., rendering which includes watermarking) skips randomly the watermarking of some channels depending on actually achieved processing speed (so that watermarking of some channels is skipped if otherwise, overall processing rate would fall below a threshold).

The inventors have recognized that watermarking (e.g., during playback in a theater) of each individual channel (or a randomly determined subset of the channels) of a multichannel audio program (or each speaker feed signal, or a randomly determined subset of the speaker feed signals, generated in response to such program) can be wasteful and inefficient. For example, watermarking of signals indicative of silent (or nearly silent) audio content will generally not contribute to an improved watermark recovery. Furthermore, watermarking of channels that are relatively quiet compared to other channels will not contribute to improved watermark recovery.

Although embodiments of the invention are useful for selectively watermarking channels of any multichannel audio program, many embodiments of the invention are especially useful for selectively watermarking channels of object-based audio programs having a large number of channels.

It is known to employ playback systems (e.g., in movie theaters) to render object based audio programs. Object based audio programs which are movie soundtracks may be indicative of many different audio objects corresponding to images on a screen, dialog, noises, and sound effects that emanate from different places on (or relative to) the screen, as well as background music and ambient effects (which may be indicated by speaker channels of the program) to create the intended overall auditory experience. Accurate playback of such programs requires that sounds be reproduced in a way that corresponds as closely as possible to what is intended by the content creator with respect to audio object size, position, intensity, movement, and depth.

During generation of object based audio programs, it is typically assumed that the loudspeakers to be employed for rendering are located in arbitrary locations in the playback environment; not necessarily in a (nominally) horizontal plane or in any other predetermined arrangements known at the time of program generation. Typically, metadata included in the program indicates rendering parameters for rendering at least one object of the program at an apparent spatial location or along a trajectory (in a three dimensional volume), e.g., using a three-dimensional array of speakers. For example, an object channel of the program may have corresponding metadata indicating a three-dimensional trajectory of apparent spatial positions at which the object (indicated by the object channel) is to be rendered. The trajectory may include a sequence of "floor" locations (in the plane of a subset of speakers which are assumed to be located on the floor, or in another horizontal plane, of the playback environment), and a sequence of "above-floor" locations (each determined by driving a subset of the speakers which are assumed to be located in at least one other horizontal plane of the playback environment).

Object based audio programs represent a significant improvement in many contexts over traditional speaker channel-based audio programs, since speaker-channel based audio is more limited with respect to spatial playback of specific audio objects than is object channel based audio. Speaker channel-based audio programs consist of speaker channels only (not object channels), and each speaker channel typically determines a speaker feed for a specific, individual speaker in a listening environment.

Various methods and systems for generating and rendering object based audio programs have been proposed. During generation of an object based audio program, it is typically assumed that an arbitrary number of loudspeakers will be employed for playback of the program, and that the loudspeakers to be employed (typically, in a movie theater)

for playback will be located in arbitrary locations in the playback environment; not necessarily in a (nominally) horizontal plane or in any other predetermined arrangement known at the time of program generation. Typically, object-related metadata included in the program indicates rendering parameters for rendering at least one object of the program at an apparent spatial location or along a trajectory (in a three dimensional volume), e.g., using a three-dimensional array of speakers. For example, an object channel of the program may have corresponding metadata indicating a three-dimensional trajectory of apparent spatial positions at which the object (indicated by the object channel) is to be rendered. The trajectory may include a sequence of "floor" locations (in the plane of a subset of speakers which are assumed to be located on the floor, or in another horizontal plane, of the playback environment), and a sequence of "above-floor" locations (each determined by driving a subset of the speakers which are assumed to be located in at least one other horizontal plane of the playback environment). Examples of rendering of object based audio programs are described, for example, in PCT International Application No. PCT/US2001/028783, published under International Publication No. WO 2011/119401 A2 on Sep. 29, 2011, and assigned to the assignee of the present application.

BRIEF DESCRIPTION OF THE INVENTION

In a class of embodiments the invention is a method for watermarking a multichannel audio program, including the steps of selecting a subset of channels of (e.g., channels determined from) at least a segment of the program for watermarking, and watermarking each channel in the subset of channels, thereby generating a set of watermarked channels (i.e., generating data indicative of a set of watermarked channels). The set of watermarked channels typically consists of a small number of watermarked channels (e.g., N channels, where $1 \leq N \leq 16$), although the program may include a much larger number of channels. In typical embodiments, the selection of which channels to watermark is based on configuration of the playback speakers (e.g., the arrangement of speakers in a room) to be employed for playback of the program, or on the program itself (e.g., it is based on metadata included in the program, or based on at least one characteristic of audio content, determined by or included in a channel of the program, to be played by at least one playback speaker). In some embodiments, the program is an object-based audio program (e.g., a movie soundtrack) and at least one object channel and/or at least one speaker channel of the program is watermarked. In some embodiments, a rendering system determines a set of playback speaker channels (each for playback by a different speaker of a playback system) from an object-based audio program (i.e., from at least one object channel and/or at least one speaker channel of the program), and a subset of this set of speaker channels is watermarked. In some embodiments, the selected subset is watermarked before speaker feeds are generated in response to channels of the program (e.g., by a decoder or playback system configured to receive, decode, and render the program, or during generation of the program to be delivered to a decoder or playback system for decoding and rendering). In some embodiments, the selected subset is watermarked (by a rendering system) after an encoded version of the program (e.g., an encoded bitstream indicative of the program) is decoded, but before speaker feeds are generated in response to audio content of the decoded program. In some embodiments, the selected subset is watermarked during rendering of the program (e.g., speaker feeds are generated in response to channels of the program, the speaker feeds correspond to, or are determined from, channels of the program, and a selected subset of the set of speaker feeds is watermarked).

Typically, the watermarking is performed in a playback system which is coupled and configured to decode and render a multichannel audio program, and which has limited watermarking capability (i.e., the playback system does not have capability to watermark an unlimited number of audio program channels).

In some embodiments, a decoder or playback system (e.g., installed in a movie theater) decodes an encoded bitstream indicative of a multichannel audio program, to determine channels (speaker channels and/or object channels) of the program, or channels (speaker channels) determined from the program. A selected subset of the channels is watermarked (before or during rendering of the decoded audio), such that when the program has undergone rendering and playback, the watermark can be determined from (e.g., by processing) the sound emitted from the speaker set during playback. Thus, if the audio is recorded (e.g., illegally, by a cell phone or other device), the watermark is detectable by processing the recorded signal. The watermark may be indicative of a playback system ID (e.g., a movie theater ID) and a playback time.

In some embodiments, the selected subset of channels is optimized for watermark detection and recovery of information embedded in the watermark. If the channel subset selection is performed during content creation (e.g., generation of an encoded version of the program), watermarking metadata (indicative of the selected subset for each segment of a sequence of segments of the program) is typically distributed along with the audio content of the program (e.g., the watermarking metadata is included in the program). Alternatively, the channel subset selection is performed during decoding, rendering, or playback.

Typical embodiments of the inventive method are expected to provide watermarking with improved watermark detectability, reduced watermarking cost, and improved quality of rendered watermarked audio (relative to that obtainable by conventional watermarking). The specific parameters of each implementation are typically determined to achieve an acceptable trade-off between robustness of watermark recovery, quality of rendered watermarked audio, and watermark information capacity.

In a first class of embodiments, the method generates watermarking metadata (e.g., watermark suitability values) during audio program creation including by analyzing the audio content to be included in segments of a multichannel audio program and determining at least one watermark suitability value (sometimes referred to herein as a "weight" or watermark suitability weight) for each channel of each of the segments of the program. In typical embodiments, each watermark suitability value ("WSV") is indicative of the suitability of the content of the corresponding channel (in the relevant segment of the program) for watermarking (e.g., the WSV may indicate RMS amplitude of the corresponding content, and/or recoverability of a watermark if the watermark is applied to the content). The suitability for watermarking may be an absolute metric (for example, on a scale of 1 to 10), or a relative metric (e.g., a WSV may indicate that speaker channel 10 is more suitable for watermarking than object channel 6, without specifying how much more suitable, so that in this example the WSV just specifies relative suitability). The watermark suitability values (or watermarking data determined therefrom) are included as metadata in the audio program (e.g., with each segment of each channel of the program including watermarking metadata indicative of watermark suitability of the segment of the channel or whether the segment of the channel should be watermarked). Using the watermarking metadata, a playback system can detect which of the channels of each segment of the program are the most suitable for watermarking or which should be watermarked.

In typical embodiments in the first class, the playback system is constrained to watermark no more than a maximum number ("N") of channels of (or determined from) an audio program being decoded and rendered. For each segment of an audio program being decoded, the playback system is configured to compare the watermarking suitability values for the program's channels (e.g., for each speaker channel of a bed of speaker channels, and each object channel, of an object-based audio program), and to identify from the watermarking suitability values a subset of N of the highest-weighted (most suitable for watermarking) channels for the segment. The identified N channels of each segment are then watermarked. When the watermarking is complete for a segment, all channels (including the N watermarked channels) to be rendered are reassembled (synchronized) and rendered (i.e., speaker feeds are generated in response to a full set of channels including the N watermarked channels).

Various embodiments of the inventive method employ different methods to determine a watermark suitability value ("WSV") for each channel of a segment of a multichannel audio program, including (but not limited to) the following:

1. the WSV for a channel of the segment is determined from the root mean square (RMS) amplitude of the channel's audio content in the segment;

2. the WSV for a channel of the segment is determined from the RMS amplitude of the channel's audio content in the segment and metadata (e.g., metadata delivered with the program) corresponding to the audio content. For example, the metadata may indicate a gain (or gain increase or decrease) to be applied to the channel's audio content in the segment, and the WSV may be determined from the RMS amplitude of the channel of the segment multiplied by such gain;

3. the segment is rendered (speaker feeds are determined for the segment from all channels of the segment) as it would be perceived in or near the center of a room (e.g., an auditorium), and the WSV for each channel of the rendered segment is determined from the RMS amplitude of said channel of the rendered segment. For example, the segment might be rendered using zone exclusion metadata (delivered with an object-based audio program) for the segment, where the zone exclusion metadata indicates which object channels are allowed (and which object channels are not allowed) to contribute to each speaker feed for the segment (e.g., the metadata might cause audio content indicative of some objects to be played back only by speakers in specific zones of a theater). Thus, if the metadata indicates that speakers in an "exclusion" zone should not emit sound indicative of a "first" object, the speaker feeds for the speakers in the exclusion zone will not be indicative of the first object and the WSV for each corresponding channel of the rendered segment will not be indicative of RMS amplitude of audio content corresponding to the first object (although it might be indicative of RMS amplitude of audio content corresponding to objects other than the first object);

4. the WSV for a channel of the segment is at least partially determined from the number of speakers to be driven to emit content indicative of the channel during rendering of the segment (e.g., the percentage of the speakers, of a full set of available speakers in a room, that will be driven to emit content indicative of the channel during rendering of the segment). Some types of watermarking work better if the watermark is spread among multiple speakers. For example, if an object channel is to be rendered as a large or "wide" object (by driving a relatively large number of speakers), this channel of the segment may be assigned a large WSV (indicating that the channel is well suited to watermarking), and if an object channel is to be rendered as a small or "narrow" object (by a relatively small number of speakers) this channel of the segment may be assigned a small WSV (indicating that the channel is not well suited to watermarking).

5. the WSV for a channel of the segment is determined from the energy or RMS amplitude of the channel's audio content in a limited frequency range. Watermarking algorithms often embed information in a limited frequency range only. When such watermarking is to be employed, it may be useful to compute the WSV from signal energy or RMS amplitude in the same frequency range as the frequency range to be watermarked;

6. the WSV for a channel of the segment is determined using a watermark embedder. Most watermarking algorithms implement a psychoacoustic model to adjust the watermark embedding strength as a function of time and frequency, to provide maximum watermark recovery with minimum impact on perceived audio quality. The embedder will therefore internally have a metric of the watermarking strength that is applied to each signal, and this metric (for a channel of a segment) can be used as a WSV value (for the channel of the segment);

7. the WSV for a channel of the segment is determined using a watermark detector. Most watermarking detectors will, besides recovering a watermark, also produce a measure of the accuracy or reliability of the extracted information (e.g., a false watermark probability, which is a probability that an extracted watermark is not correct). Such a measure (determined by a watermark detector for a channel of a segment) can be used as a WSV value (for the channel of the segment) or to determine at least partially the WSV for the channel of the segment;

8. the WSV for a channel of the segment is determined using at least one other feature (of the channel's audio content in the segment) besides RMS or signal amplitude. For example, spread-spectrum watermarking techniques work best on wide-band audio signals and often do not perform well on narrow-band signals. The bandwidth, spectral flatness, or any other feature representative of the shape of the spectrum of the channel's audio content in the segment can be useful to estimate the robustness of the watermark detection process, and thus may be used to determine at least partially the WSV for the channel of the segment;

Preferably, the WSVs for the channels of a segment of a program are (or can be processed to determine) an ordered list which indicates the channels in increasing or decreasing order of suitability for watermarking. In this way, a best possible watermarking effort can be obtained which is independent of a playback system's watermarking capabilities. Because audio signals are typically time varying and dynamic in nature, the ordered list is preferably time dependent (i.e., an ordered list is determined for each segment of a program).

Such an ordered list can be split into a list of a first set of channels ("absolutely required" channels) that must be watermarked to guarantee a minimum quality of service (e.g., watermark detection robustness), and a second, ordered list which may be employed to select additional channels to be watermarked if the capabilities of the watermarking system allow for watermarking of more than just the "absolutely required" channels.

In a second class of embodiments, the invention is implemented by a playback system only, and does not require that an encoding system which generates the multichannel audio program (to be watermarked and rendered for playback) be configured in accordance with an embodiment of the invention (i.e., the encoding system need not identify WSVs for channels of the program). In these embodiments, the playback system determines the WSVs for channels of each segment of the program.

In some embodiments in the second class, the playback system selects for watermarking a subset of a set of individual speaker channels determined from the multichannel program. For example, if the program is an object-based audio program including object channels as well as a bed of speaker channels, the playback system may determine a set of playback speaker channels (each playback speaker channel corresponding to a different speaker of a set of playback speakers) from the object channels and/or speaker channels of the program, and the playback system then selects a subset of the playback speaker channels for watermarking. The subset selection for a segment of the program may be based on RMS amplitude of each speaker channel determined from the segment of the program.

In some embodiments in the second class, the playback system uses the configuration of the playback speakers (installed in an auditorium or other playback environment) to select the subset of channels to be watermarked, including by identifying groups (subsets) of the full set of playback speakers in distinct locations (zones) in the playback environment. These embodiments includes steps of: determining from channels of the program a set of playback speaker channels, each for playback by a different one of the playback speakers, selecting a subset of the set of playback speaker channels for watermarking, and watermarking each channel in the subset of the set of playback speaker channels (thereby generating a set of watermarked channels), including by identifying groups of the playback speakers which are installed in distinct zones in the playback environment such that each of the groups consists of speakers installed in a different one of the zones, identifying suitability for watermarking of audio content for playback by each of the groups, and selecting the subset of the set of playback speaker channels in accordance with the suitability for watermarking of audio content for playback by each of at least a subset of the groups. Typically, the audio content (e.g., object channel content and speaker channel content) of the program (or a segment of the program) is rendered, thereby determining the set of playback speaker channels (each playback speaker channel corresponding to, and indicative of content to be played by, a different speaker of the set of playback speakers), and the playback system selects one playback speaker channel (or a small number of playback speaker channels) corresponding to each of the groups of speakers (e.g., a speaker channel for driving one speaker in each of the groups) or each of a subset of the groups, and watermarks each such selected playback speaker channel. This can result in watermarking of only channels that typically indicate audio content of specific type(s), and can enable recovery (with a high probability of success) of the watermarks without incurring large computation costs. These embodiments do not measure the loudness (or another characteristic) of the audio content of each channel selected for watermarking. Instead, they assume that some playback speaker channels (of a full set of playback speaker channels) are suitable for watermarking (e.g., are likely to be indicative of loud content, and/or content of specific type(s)) and should be watermarked. Typically, only playback speaker channels that are assumed to be likely to be suitable for watermarking are watermarked, and a signal for driving a speaker from each group of the full set of speakers is watermarked.

Aspects of the invention include a system or device configured (e.g., programmed) to implement any embodiment of the inventive method, a system or device including a buffer which stores (e.g., in a non-transitory manner) at least one frame or other segment of a multichannel audio program generated by any embodiment of the inventive method or steps thereof, and a computer readable medium (e.g., a disc) which stores code (e.g., in a non-transitory manner) for implementing any embodiment of the inventive method or steps thereof. For example, the inventive system can be or include a programmable general purpose processor, digital signal processor, or microprocessor, programmed with software or firmware and/or otherwise configured to perform any of a variety of operations on data, including an embodiment of the inventive method or steps thereof. Such a general purpose processor may be or include a computer system including an input device, a memory, and processing circuitry programmed (and/or otherwise configured) to perform an embodiment of the inventive method (or steps thereof) in response to data asserted thereto.

NOTATION AND NOMENCLATURE

Figure 1:
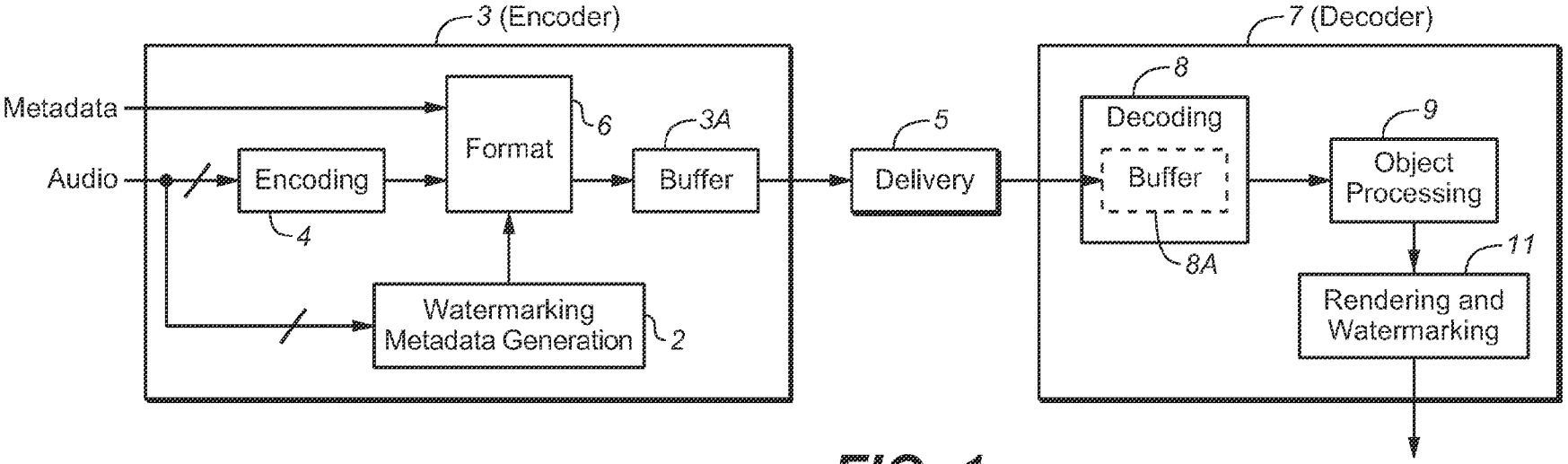
FIG. 1 is a block diagram of a system including an encoder, a delivery subsystem, and a decoder. The encoder and/or the decoder are configured in accordance with an embodiment of the invention.

Throughout this disclosure, including in the claims, the expression performing an operation "on" a signal or data (e.g., filtering, scaling, transforming, or applying gain to, the signal or data) is used in a broad sense to denote performing the operation directly on the signal or data, or on a processed version of the signal or data (e.g., on a version of the signal that has undergone preliminary filtering or pre-processing prior to performance of the operation thereon).

Throughout this disclosure including in the claims, the expression "system" is used in a broad sense to denote a device, system, or subsystem. For example, a subsystem that implements a decoder may be referred to as a decoder system, and a system including such a subsystem (e.g., a system that generates X output signals in response to multiple inputs, in which the subsystem generates M of the inputs and the other X-M inputs are received from an external source) may also be referred to as a decoder system.

Throughout this disclosure including in the claims, the term "processor" is used in a broad sense to denote a system or device programmable or otherwise configurable (e.g., with software or firmware) to perform operations on data (e.g., audio, or video or other image data). Examples of processors include a field-programmable gate array (or other configurable integrated circuit or chip set), a digital signal processor programmed and/or otherwise configured to perform pipelined processing on audio or other sound data, a programmable general purpose processor or computer, and a programmable microprocessor chip or chip set.

Throughout this disclosure including in the claims, the expressions "audio processor" and "audio processing unit" are used interchangeably, and in a broad sense, to denote a system configured to process audio data. Examples of audio processing units include, but are not limited to encoders (e.g., transcoders), decoders, codecs, pre-processing systems, post-processing systems, and bitstream processing systems (sometimes referred to as bitstream processing tools).

Throughout this disclosure including in the claims, the expression "metadata" (e.g., as in the expression "processing state metadata") refers to separate and different data from corresponding audio data (audio content of a bitstream which also includes metadata). Metadata is associated with audio data, and indicates at least one feature or characteristic of the audio data (e.g., what type(s) of processing have already been performed, or should be performed, on the audio data, or the trajectory of an object indicated by the audio data). The association of the metadata with the audio data is time-synchronous. Thus, present (most recently received or updated) metadata may indicate that the corresponding audio data contemporaneously has an indicated feature and/or comprises the results of an indicated type of audio data processing.

Throughout this disclosure including in the claims, the term "couples" or "coupled" is used to mean either a direct or indirect connection. Thus, if a first device couples to a second device, that connection may be through a direct connection, or through an indirect connection via other devices and connections.

Throughout this disclosure including in the claims, the following expressions have the following definitions:

speaker and loudspeaker are used synonymously to denote any sound-emitting transducer. This definition includes loudspeakers implemented as multiple transducers (e.g., woofer and tweeter);

speaker feed: an audio signal to be applied directly to a loudspeaker, or an audio signal that is to be applied to an amplifier and loudspeaker in series;

channel (or "audio channel"): a monophonic audio signal. Such a signal can typically be rendered in such a way as to be equivalent to application of the signal directly to a loudspeaker at a desired or nominal position. The desired position can be static, as is typically the case with physical loudspeakers, or dynamic;

audio program: a set of one or more audio channels (at least one speaker channel and/or at least one object channel) and optionally also associated metadata (e.g., metadata that describes a desired spatial audio presentation);

speaker channel (or "speaker-feed channel"): an audio channel that is associated with a named loudspeaker (at a desired or nominal position), or with a named speaker zone within a defined speaker configuration. A speaker channel is rendered in such a way as to be equivalent to application of the audio signal directly to the named loudspeaker (at the desired or nominal position) or to a speaker in the named speaker zone;

object channel: an audio channel indicative of sound emitted by an audio source (sometimes referred to as an audio "object"). Typically, an object channel determines a parametric audio source description (e.g., metadata indicative of the parametric audio source description is included in or provided with the object channel). The source description may determine sound emitted by the source (as a function of time), the apparent position (e.g., 3D spatial coordinates) of the source as a function of time, and optionally at least one additional parameter (e.g., apparent source size or width) characterizing the source;

object based audio program: an audio program comprising a set of one or more object channels (and optionally also comprising at least one speaker channel) and optionally also associated metadata (e.g., metadata indicative of a trajectory of an audio object which emits sound indicated by an object channel, or metadata otherwise indicative of a desired spatial audio presentation of sound indicated by an object channel, or metadata indicative of an identification of at least one audio object which is a source of sound indicated by an object channel); and render: the process of converting an audio program into one or more speaker feeds, or the process of converting an audio program into one or more speaker feeds and converting the speaker feed(s) to sound using one or more loudspeakers (in the latter case, the rendering is sometimes referred to herein as rendering "by" the loudspeaker(s)). An audio channel can be trivially rendered ("at" a desired position) by applying the signal directly to a physical loudspeaker at the desired position, or one or more audio channels can be rendered using one of a variety of virtualization techniques designed to be substantially equivalent (for the listener) to such trivial rendering. In this latter case, each audio channel may be converted to one or more speaker feeds to be applied to loudspeaker(s) in known locations, which are in general different from the desired position, such that sound emitted by the loudspeaker(s) in response to the feed(s) will be perceived as emitting from the desired position. Examples of such virtualization techniques include binaural rendering via headphones (e.g., using Dolby Headphone processing which simulates up to 7.1 channels of surround sound for the headphone wearer) and wave field synthesis.

DETAILED DESCRIPTION OF EMBODIMENTS OF THE INVENTION

Examples of embodiments of the invention will be described with reference to FIGS. 1, 2, 3, 4, and 5.

FIG. 1 is a block diagram of an audio data processing system, in which one or more of the elements of the system are configured in accordance with an embodiment of the present invention. The FIG. 1 system includes encoder 3, delivery subsystem 5, and decoder 7, coupled together as shown. Although subsystem 7 is referred to herein as a "decoder" it should be understood that it is typically implemented as a playback system including a decoding subsystem (configured to parse and decode a bitstream indicative of an encoded multichannel audio program) and other subsystems configured to implement rendering (including watermarking) and at least some steps of playback of the decoding subsystem's output. Some embodiments of the invention are decoders (e.g., a decoder including a buffer memory of the type described herein) which are not configured to perform rendering and/or playback (and which would typically be used with a separate rendering and/or playback system). Some embodiments of the invention are playback systems (e.g., a playback system including a decoding subsystem and other subsystems configured to implement rendering (including watermarking) at least some steps of playback of the decoding subsystem's output).

A typical implementation of encoder 3 is configured to generate an object-based, encoded multichannel audio program in response to multiple streams of audio data and metadata provided to encoder 3 (as indicated in FIG. 1) or generated by encoder 3. A bitstream indicative of the program is output from encoder 3 to delivery subsystem 5. In other implementations, encoder 3 is configured to generate a multichannel audio program which is not an object-based encoded audio program, and to output a bitstream indicative of the program to delivery subsystem 5. The program generated by encoder 3 is delivered by delivery subsystem 5 to decoder 7, for decoding (by subsystem 8), object processing (by subsystem 9), and rendering (by system 11) for playback by playback system speakers (not shown).

Encoding subsystem 4 of encoder 3 is configured to encode multiple streams of audio data to generate encoded audio bitstreams indicative of audio content of each of the channels (speaker channels and typically also object channels) to be included in the program. The encoding performed by subsystem 4 typically implements compression, so that at least some of the encoded bitstreams output from subsystem 4 are compressed audio bitstreams.

In typical implementations of encoder 3, a watermarking metadata generation subsystem 2 of encoder 3 is coupled and configured to generate watermarking metadata (e.g., watermark suitability values) in accordance with an embodiment of the present invention. The watermarking metadata may be generated by any of the methods described herein. For example, it may be generated by analyzing the audio data to be indicated by segments of the multichannel audio program (to be generated by encoder 3) and determining at least one watermark suitability value for each channel of each of the segments of the program. In some embodiments, the watermarking metadata for a channel of a segment is determined from the root mean square (RMS) amplitude of the channel's audio content in the segment. In some embodiments, the watermarking metadata is generated by analyzing the audio data to be indicated by segments of the program and metadata corresponding to the audio data. For example, the watermarking metadata for a channel of a segment may be determined from the RMS amplitude of the channel's audio content in the segment and from metadata corresponding to such audio content.

In other implementations, watermarking metadata generation subsystem 2 is omitted from encoder 3, and any watermark suitability values needed to perform an embodiment of the inventive channel-selective watermarking are generated in a playback system or decoder (e.g., in an implementation of subsystem 11 of decoder 7).

Formatting stage 6 of encoder 6 is coupled and configured to assemble the encoded audio bitstreams output from subsystem 4 and corresponding metadata (including watermarking metadata generated by subsystem 2) into an multichannel audio program (i.e., a bitstream indicative of such a program).

In a typical implementation, encoder 3 includes buffer 3A, which stores (e.g., in a non-transitory manner) at least one frame or other segment of the multichannel audio program (e.g., object based audio program) output from stage 6. The program is output from buffer 3A for delivery by subsystem 5 to decoder 7. Typically, the program is an object based audio program, and each segment (or each of some of the segments) of the program includes audio content of a bed of speaker channels, audio content of a set of object channels, and metadata. The metadata typically includes object related metadata for the object channels and watermarking metadata (e.g., watermark suitability values) for the object channels and speaker channels (in implementations in which a watermarking metadata generation subsystem 2 of encoder 3 has generated such watermarking metadata).

Decoder 7 of FIG. 1 includes decoding subsystem 8, object processing subsystem 9, and rendering (and watermarking) subsystem 11, coupled together as shown. In variations on the system shown, one or more of the elements are omitted or additional audio data processing units are included. In some implementations, decoder 7 is or is included in a playback system (e.g., in a movie theater, or an end user's home theater system) which typically includes a set of playback speakers (e.g., the speakers shown in FIG. 5).

In some implementations, decoder 7 is configured in accordance with an embodiment of the present invention to determine watermark suitability values for channels of a multichannel audio program (e.g., an object-based, multichannel audio program) delivered by subsystem 5. In these implementations, decoder 7 is typically also configured to perform watermarking (e.g., in subsystem 11) of some channels of the program using such watermark suitability values.

In some implementations, decoder 7 and encoder 3 considered together are configured to perform an embodiment of the present invention. In these implementations, encoder 3 is configured to determine watermarking metadata (e.g., watermark suitability values) for channels of a multichannel audio program (e.g., an object-based, multichannel audio program) to be delivered and to include such watermarking metadata in the program, and decoder 7 is configured to identify (parse) the watermarking metadata (e.g., watermark suitability values or values determined therefrom) for the corresponding channels of the program (which has been delivered to decoder 7) and to perform watermarking of selected channels of the program using the watermark metadata.

Delivery subsystem 5 of FIG. 1 is configured to store and/or transmit (e.g., broadcast) the program generated by encoder 3. In some embodiments, subsystem 5 implements delivery of (e.g., transmits) a multichannel audio program (e.g., an object based audio program) over a broadcast system or a network (e.g., the internet) to decoder 7. In some other embodiments, subsystem 5 stores a multichannel audio program (e.g., an object based audio program) in a storage medium (e.g., a disk or set of disks), and decoder 7 is configured to read the program from the storage medium.

In typical operation, decoding subsystem 8 of decoder 7 accepts (receives or reads) the program delivered by delivery subsystem 5. In a typical implementation, subsystem 8 includes buffer 8A, which stores (e.g., in a non-transitory manner) at least one frame or other segment (typically including audio content of a bed of speaker channels, audio content of object channels, and metadata) of an object based audio program delivered to decoder 7. The metadata typically includes object related metadata for object channels of the program and may also include watermarking metadata (e.g., watermark suitability values) generated in accordance with an embodiment of the invention for object channels and speaker channels of the program. Decoding subsystem 8 reads each segment of the program from buffer 8A and decodes each such segment. Typically, subsystem 8 parses a bitstream indicative of the program to identify speaker channels (e.g., of a bed of speaker channels), object channels and metadata, decodes the speaker channels, and outputs to subsystem 9 the decoded speaker channels and metadata.

Subsystem 8 also decodes (if necessary) all or some of the object channels and outputs the object channels (including any decoded object channels) to subsystem 9.

Object processing subsystem 9 is coupled to receive (from decoding subsystem 8) audio samples of decoded speaker channels and object channels (including any decoded object channels), and metadata of the delivered program, and to output to rendering subsystem 11 a set of object channels (e.g., a selected subset of a full set of object channels) indicated by or determined from the program, and corresponding metadata. Subsystem 9 is typically also configured to pass through unchanged (to subsystem 11) the decoded speaker channels output from subsystem 8, and metadata corresponding thereto. Subsystem 9 may be configured to process at least some of the object channels (and/or metadata) asserted thereto to generate the object channels and corresponding metadata that it asserts to subsystem 11. Subsystem 9 is typically configured to determine a set of selected object channels (e.g., all the object channels of a delivered program, or a subset of a full set of object channels of the program, where the subset is determined by default or in another manner), and to output to subsystem 11 the selected object channels and metadata corresponding thereto. The object selection may be determined by user selection (as indicated by control data asserted to subsystem 9 from a controller) and/or rules (e.g., indicative of conditions and/or constraints) which subsystem 9 has been programmed or otherwise configured to implement.

If subsystem 9 is configured in accordance with a typical embodiment of the invention, the output of subsystem 9 in typical operation includes the following:

- streams of audio samples indicative of a delivered program's bed of speaker channels (and optionally also corresponding metadata, e.g., watermark suitability values for the speaker channels); and
- streams of audio samples indicative of object channels of the program (or object channels determined from object channels of the program, e.g., by mixing) and corresponding streams of metadata (including object related metadata and optionally also watermark suitability values for the object channels).

Rendering subsystem 11 is configured to render the audio content determined by subsystem 9's output for playback by playback system speakers (not shown in FIG. 1). The rendering includes watermarking of selected channels of the audio content (typically using watermark suitability values received from subsystem 9 or generated by subsystem 11). Subsystem 11 is configured to map, to the available playback speaker channels, the audio objects determined by the object channels output from subsystem 9, using rendering parameters output from subsystem 9 (e.g., object-related metadata values, which may be indicative of level and spatial position or trajectory). Typically, at least some of the rendering parameters are determined by the object related metadata output from subsystem 9. Rendering system 11 also receives the bed of speaker channels passed through by subsystem 9. Typically, subsystem 11 is an intelligent mixer, and is configured to determine speaker feeds for the available playback speakers including by mapping one or more objects (determined by the output of subsystem 9) to each of a number of individual speaker channels, and mixing the objects with "bed" audio content indicated by each corresponding speaker channel of the program.

In some embodiments, the speakers to be driven to render the audio are assumed to be located in arbitrary locations in the playback environment; not merely in a (nominally) horizontal plane. In some such cases, metadata included in the program indicates rendering parameters for rendering at least one object of the program at any apparent spatial location (in a three dimensional volume) using a three-dimensional array of speakers. For example, an object channel may have corresponding metadata indicating a three-dimensional trajectory of apparent spatial positions at which the object (indicated by the object channel) is to be rendered. The trajectory may include a sequence of "floor" locations (in the plane of a subset of speakers which are assumed to be located on the floor, or in another horizontal plane, of the playback environment), and a sequence of "above-floor" locations (each determined by driving a subset of the speakers which are assumed to be located in at least one other horizontal plane of the playback environment). In such cases, the rendering can be performed in accordance with the present invention so that the speakers can be driven to emit sound (determined by the relevant object channel) that will be perceived as emitting from a sequence of object locations in the three-dimensional space which includes the trajectory, mixed with sound determined by the "bed" audio content.

Optionally, a digital audio processing ("DAP") stage (e.g., one for each of a number of predetermined output speaker channel configurations) is coupled to the output of rendering subsystem 11 to perform post-processing on the output of the rendering subsystem. Examples of such processing include intelligent equalization or speaker virtualization processing.

The output of rendering subsystem 11 (or a DAP stage following subsystem 11) may be PCM bitstreams (which determine speaker feeds for the available speakers).

In a class of embodiments, the invention is a method for watermarking a multichannel audio program, including the steps of selecting a subset of channels of (e.g., channels determined from) at least a segment of the program for watermarking, and watermarking each channel in the subset of channels. In some embodiments, the program is an object-based audio program (e.g., a movie soundtrack) and at least one object channel and/or at least one speaker channel of the program is watermarked. In some embodiments, a rendering system (e.g., an implementation of subsystem 11 of decoder 7 of FIG. 1) determines a set of playback speaker channels (each for playback by a different speaker of a playback system) from an object-based audio program (i.e., from at least one object channel and/or at least one speaker channel of the program), and a subset of this set of speaker channels is watermarked. In some embodiments, the selected subset is watermarked before speaker feeds are generated in response to channels of the program (e.g., by a decoder configured to receive, decode, and render the program, or during generation of the program to be delivered to a decoder for decoding and rendering). In some embodiments, the selected subset is watermarked (by a rendering system) after an encoded version of the program (e.g., an encoded bitstream indicative of the program) is decoded, but before speaker feeds are generated in response to audio content of the decoded program. In some embodiments, the selected subset is watermarked during rendering of the program (e.g., speaker feeds are generated in response to channels of the program, the speaker feeds correspond to, or are determined from, channels of the program, and a selected subset of the set of speaker feeds is watermarked).

Typically, the watermarking is performed in a playback system (e.g., in an implementation of decoder 7 of FIG. 1) which is coupled and configured to decode and render a multichannel audio program, and which has limited watermarking capability (i.e., the playback system does not have capability to watermark an unlimited number of audio program channels).

In some embodiments, a decoder (e.g., installed in a movie theater) decodes an encoded bitstream indicative of a multichannel audio program, to determine channels (speaker channels and/or object channels) of the program, or channels (speaker channels) determined from the program. A selected subset of the channels is watermarked (before or during rendering of the decoded audio), such that when the program has undergone rendering and playback, the watermark can be determined from (e.g., by processing) the sound emitted from the speaker set during playback. Thus, if the audio is recorded (e.g., illegally, by a cell phone or other device), the watermark is detectable by processing the recorded signal. The watermark may be indicative of a playback system ID (e.g., a movie theater ID) and a playback time.

In some embodiments, the selected subset of channels is optimized for watermark detection and recovery of information embedded in the watermark. If the channel subset selection is performed during content creation (e.g., generation of an encoded version of the program), watermarking metadata (indicative of the selected subset for each segment of a sequence of segments of the program) is typically distributed along with the audio content of the program (e.g., the watermarking metadata is included in the program). Alternatively, the channel subset selection is performed during decoding, rendering, or playback.

Typical embodiments of the inventive method are expected to provide watermarking with improved watermark detectability, reduced watermarking cost, and improved quality of rendered watermarked audio (relative to that obtainable by conventional watermarking). The specific parameters of each implementation are typically determined to achieve an acceptable trade-off between robustness of watermark recovery, quality of rendered watermarked audio, and watermark information capacity.

In a first class of embodiments, the inventive method generates watermarking metadata (e.g., watermark suitability values) during audio program creation (e.g., in subsystem 2 of an implementation of encoder 3 of FIG. 1) including by analyzing the audio content to be included in segments of a multichannel audio program (e.g., analyzing the audio content in segments of the program each having a duration of T minutes, where the value of T is based on the watermarking algorithms to be used and amount of time required for watermark recovery) and determining at least one watermark suitability value (sometimes referred to herein as a "weight" or watermark suitability weight) for each channel of each of the segments of the program. In typical embodiments, each watermark suitability value ("WSV") is indicative of the suitability of the content of the corresponding channel (in the relevant segment of the program) for watermarking (e.g., the WSV may indicate RMS amplitude of the corresponding content, and/or recoverability of a watermark if the watermark is applied to the content). The watermark suitability values (or watermarking data determined therefrom) are included as metadata in the audio program (e.g., with each segment of each channel of the program including watermarking metadata indicative of watermark suitability of the segment of the channel or whether the segment of the channel should be watermarked). Using the watermarking metadata, a playback system can detect (typically, easily) which of the channels of each segment of the program are the most suitable for watermarking or which should be watermarked.

In typical embodiments in the first class, the playback system is constrained to watermark no more than a maximum number ("N") of channels of (or determined from) an audio program being decoded and rendered. For each segment of an audio program being decoded, the playback system is configured to compare the watermarking suitability values for the program's channels (e.g., for each speaker channel of a bed of speaker channels, and each object channel, of an object-based audio program), and to identify from the watermarking suitability values a subset of N of the highest-weighted (most suitable for watermarking) channels for the segment. The identified N channels of each segment are then watermarked. When the watermarking is complete for a segment, all channels (including the N watermarked channels) to be rendered are reassembled (synchronized) and rendered (i.e., speaker feeds are generated in response to a full set of channels including the N watermarked channels).

Figure 2:
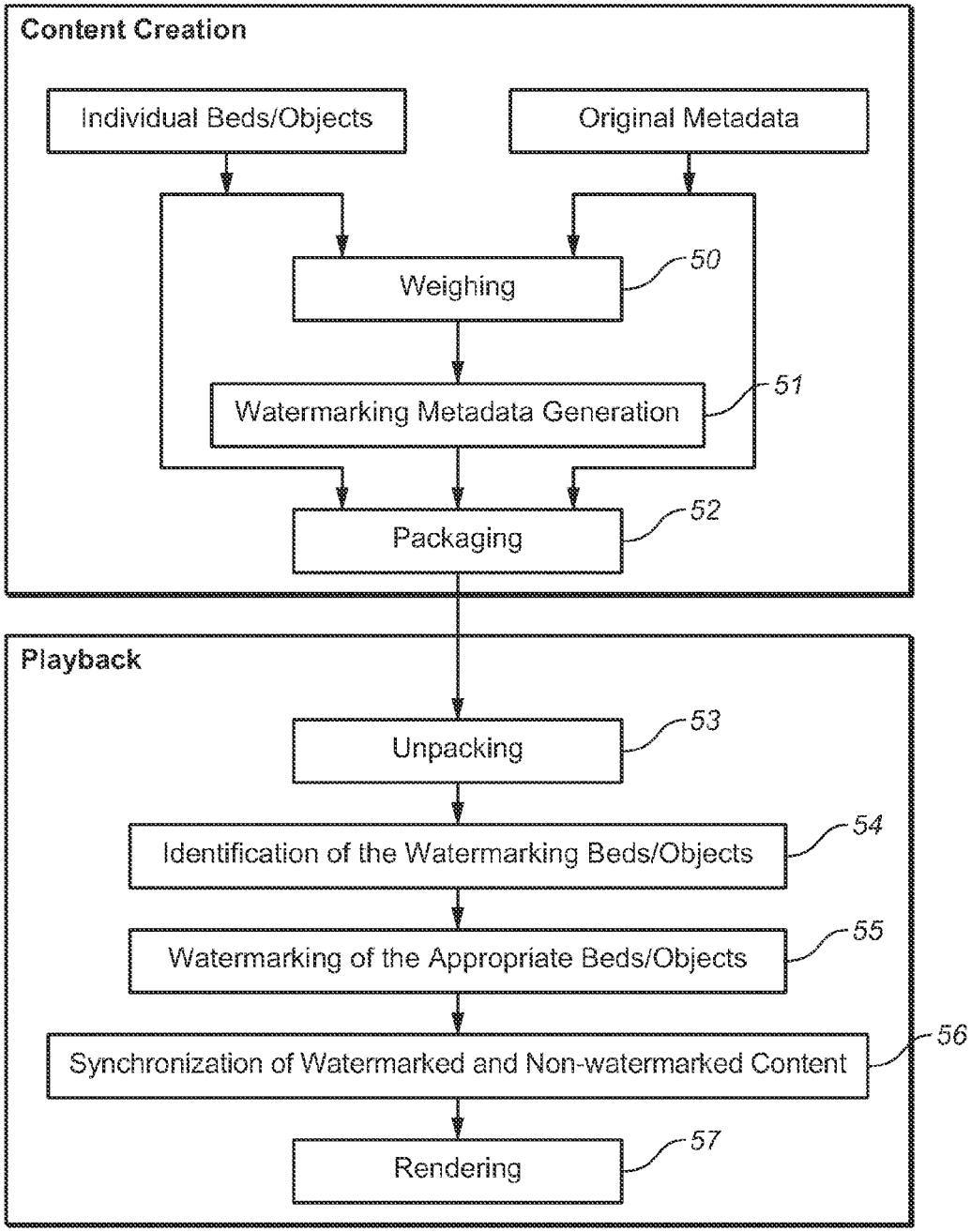
FIG. 2 is a diagram of an embodiment of the inventive method.

FIG. 2 is a diagram of an embodiment in the first class. As indicated in FIG. 2, the process of generating the multichannel program to be watermarked and rendered (the "content creation" process, which may be performed by an implementation of encoder 3 of FIG. 1) includes steps of:

a "weighing" step (50), which includes determining watermarking suitability of each channel of a segment of the program (i.e., each speaker channel of each "bed" of speaker channels of the segment, and each object channel of the segment) from the channel's content in the segment (e.g., the RMS amplitude of the channel's audio content in the segment) and optionally also from metadata corresponding to the audio content;

a step (51) of determining a watermark suitability value ("WSV") for each channel of the segment, to be included as metadata for the corresponding audio content of each channel of the segment;

a packaging step (52), which encodes the segment as a bitstream including the samples (typically, encoded samples) of audio content of each channel of the segment packaged with the corresponding WSV (determined in step 51) and original metadata for each said channel of the segment.

As indicated in FIG. 2, the process of playback of the multichannel program generated in step 52 (which may be performed by an implementation of decoder 7 of FIG. 1) includes steps of:

an unpacking step (53), which includes parsing of a segment of the program into the audio content of each channel of the segment (and performing any necessary decoding of the audio samples indicative of such audio content), the WSV corresponding to the channel of the segment, and other metadata corresponding to the channel of the segment;

a step (54) of processing the WSV values for the channels of the segment to identify (select) which of the channels should be watermarked;

a step (55) of watermarking each of channels of the segment which was selected in step 54;

a step (56) of synchronizing the watermarked audio content of each watermarked channel of the segment and the non-watermarked audio content of each other channel of the segment to be rendered; and a step (57) of rendering the synchronized watermarked and non-watermarked audio content of each channel of the segment to be rendered, thereby generating speaker feeds for each said channel of the segment.

Various embodiments of the inventive method employ different methods to determine a watermark suitability value ("WSV") for each channel of a segment of a multichannel audio program, including (but not limited to) the following:

1. the WSV for a channel of the segment is determined from (e.g., is determined to be) the root mean square (RMS) amplitude of the channel's audio content in the segment;

2. the WSV for a channel of the segment is determined from the RMS amplitude of the channel's audio content in the segment and metadata (delivered with the program) corresponding to the audio content. For example, the metadata may indicate a gain (or gain increase or decrease) to be applied to the channel's audio content in the segment;

3. the segment is rendered (speaker feeds are determined for the segment from all channels of the segment) as it would be perceived in or near the center of a room (e.g., an auditorium), and the WSV for each channel of the rendered segment is determined (e.g., by an implementation of subsystem 11 of decoder 7 of FIG. 1, or by subsystem 2 of encoder 3 of FIG. 1) from the RMS amplitude of said channel of the rendered segment. For example, the segment might be rendered using zone exclusion metadata (delivered with an object-based audio program) for the segment, where the zone exclusion metadata indicates which object channels are allowed (and which object channels are not allowed) to contribute to each speaker feed for the segment (e.g., the metadata might cause audio content indicative of some objects to be played back only by speakers in specific zones of a theater). Thus, if the metadata indicates that speakers in an "exclusion" zone should not emit sound indicative of a "first" object, the speaker feeds for the speakers in the exclusion zone will not be indicative of the first object and the WSV for each corresponding channel of the rendered segment will not be indicative of RMS amplitude of audio content corresponding to the first object (although it might be indicative of RMS amplitude of audio content corresponding to objects other than the first object);

4. the WSV for a channel of the segment is at least partially determined from the number of speakers to be driven to emit content indicative of the channel during rendering of the segment (e.g., the percentage of the speakers, of a full set of available speakers in a room, that will be driven to emit content indicative of the channel during rendering of the segment). Some types of watermarking work better if the watermark is spread among multiple speakers. For example, if an object channel is to be rendered as a large or "wide" object (by driving a relatively large number of speakers), this channel of the segment may be assigned a large WSV (indicating that the channel is well suited to watermarking), and if an object channel is to be rendered as a small or "narrow" object (by a relatively small number of speakers) this channel of the segment may be assigned a small WSV (indicating that the channel is not well suited to watermarking).

5. the WSV for a channel of the segment is determined from the energy or RMS amplitude of the channel's audio content in a limited frequency range. Watermarking algorithms often embed information in a limited frequency range only. When such watermarking is to be employed, it may be useful to compute the WSV from signal energy or RMS amplitude in the same frequency range as the frequency range to be watermarked;

6. the WSV for a channel of the segment is determined using a watermark embedder (e.g., implemented by an embodiment of subsystem 11 of decoder 7 of FIG. 1). Most watermarking algorithms implement a psychoacoustic model to adjust the watermark embedding strength as a function of time and frequency, to provide maximum watermark recovery with minimum impact on perceived audio quality. The embedder will therefore internally have a metric of the watermarking strength that is applied to each signal, and this metric (for a channel of a segment) can be used as a WSV value (for the channel of the segment);

7. the WSV for a channel of the segment is determined using a watermark detector (e.g., implemented by an embodiment of subsystem 11 of decoder 7 of FIG. 1). Most watermarking detectors will, besides recovering a watermark, also produce a measure of the accuracy or reliability of the extracted information (e.g., a false watermark probability, which is a probability that an extracted watermark is not correct). Such a measure (determined by a watermark detector for a channel of a segment) can be used as a WSV value (for the channel of the segment) or to determine at least partially the WSV for the channel of the segment;

8. the WSV for a channel of the segment is determined using at least one other feature (of the channel's audio content in the segment) besides RMS or signal amplitude. For example, spread-spectrum watermarking techniques work best on wide-band audio signals and often do not perform well on narrow-band signals. The bandwidth, spectral flatness, or any other feature representative of the shape of the spectrum of the channel's audio content in the segment can be useful to estimate the robustness of the watermark detection process, and thus may be used to determine at least partially the WSV for the channel of the segment;

Preferably, the WSVs for the channels of a segment of a program are (or can be processed to determine) an ordered list which indicates the channels in increasing or decreasing order of suitability for watermarking. In this way, a best possible watermarking effort can be obtained which is independent of a playback system's watermarking capabilities. Because audio signals are typically time varying and dynamic in nature, the ordered list is preferably time dependent (i.e., an ordered list is determined for each segment of a program).

Such an ordered list can be split into a list of a first set of channels ("absolutely required" channels) that must be watermarked to guarantee a minimum quality of service (e.g., watermark detection robustness), and a second, ordered list which may be employed to select additional channels to be watermarked if the capabilities of the watermarking system allow for watermarking of more than just the "absolutely required" channels.

Figure 3:
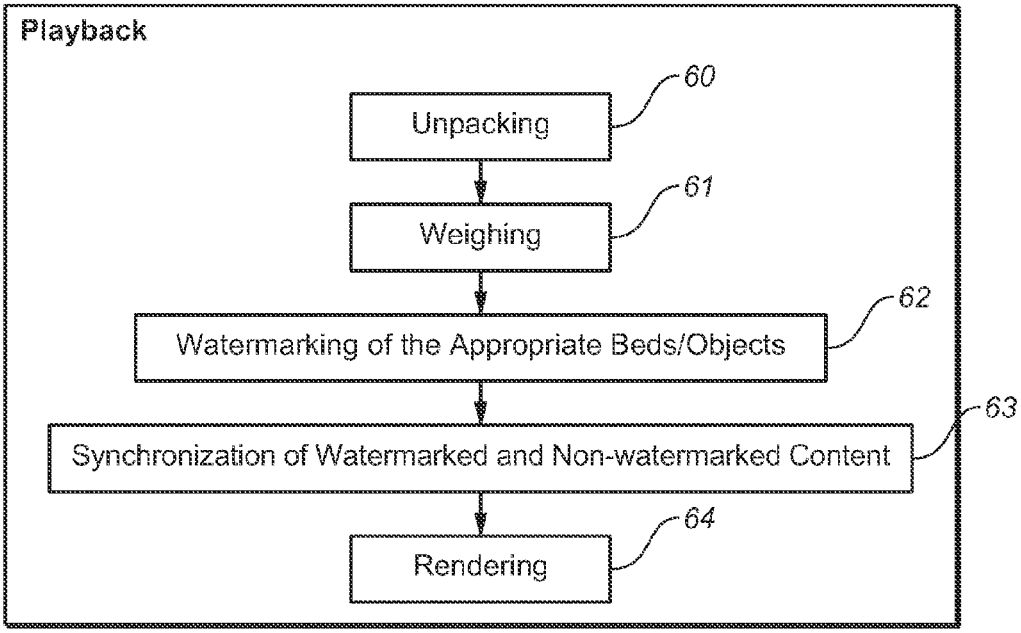
FIG. 3 is a diagram of another embodiment of the inventive method.

In a second class of embodiments, the invention is implemented by a playback system only (e.g., by an implementation of decoder 7 of FIG. 1), and does not require that an encoding system which generates the multichannel audio program (to be watermarked and rendered for playback) be configured in accordance with an embodiment of the invention (i.e., the encoding system need not identify WSVs for channels of the program). In these embodiments, the playback system determines the WSVs for channels of each segment of the program, e.g., using any of the methods described above. FIG. 3 is a diagram of such an embodiment in the second class (which may be performed by an implementation of decoder 7 of FIG. 1).

As indicated in FIG. 3, the process of playback of the multichannel program includes steps of:

an unpacking step (60), which includes parsing of a segment of the program into the audio content (and any corresponding metadata) of each channel of the segment (and performing any necessary decoding of the audio samples indicative of such audio content);

a "weighing" step (61), which includes generating watermarking suitability data indicative of suitability for watermarking of each channel of a segment of the program (i.e., each speaker channel of each "bed" of speaker channels of the segment, and each object channel of the segment) from the channel's content in the segment (e.g., the RMS amplitude of the channel's audio content in the segment) and optionally also from metadata corresponding to the audio content;

a step (62) of selecting a subset of the channels of the segment using the watermarking suitability data, and watermarking each channel of the subset of the channels of the segment;

a step (63) of synchronizing the watermarked audio content of each watermarked channel of the segment and the non-watermarked audio content of each other channel of the segment to be rendered; and a step (64) of rendering the synchronized watermarked and non-watermarked audio content of each channel of the segment to be rendered, thereby generating speaker feeds for each said channel of the segment.

Figure 4:
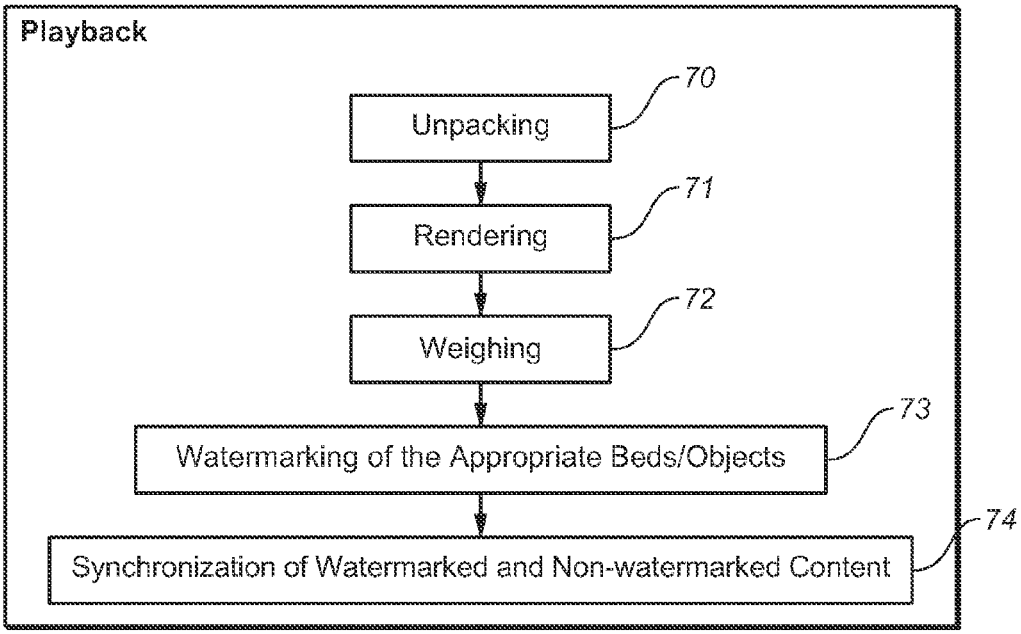
FIG. 4 is a diagram of an embodiment of the inventive method.

In some embodiments in the second class, the playback system selects for watermarking a subset of a set of individual speaker channels determined from the multichannel program. For example, if the program is an object-based audio program including object channels as well as a bed of speaker channels, the playback system (e.g., an implementation of subsystem 11 of decoder 7 of FIG. 1) may determine a set of playback speaker channels (each playback speaker channel corresponding to a different speaker of a set of playback speakers) from the object channels and/or speaker channels of the program, and the playback system then selects a subset of the playback speaker channels for watermarking. The subset selection for a segment of the program may be based on RMS amplitude of each speaker channel determined from the segment of the program, or it may be based on another criterion. FIG. 4 is a diagram of such an embodiment in the second class (which may be performed by an implementation of decoder 7 of FIG. 1).

As indicated in FIG. 4, the process of playback of the multichannel program includes steps of:

an unpacking step (70), which includes parsing of a segment of the program into the audio content (and any corresponding metadata) of each channel of the segment (and performing any necessary decoding of the audio samples indicative of such audio content);

a step (71) of rendering audio content of the segment, thereby determining a set of playback speaker channels (each playback speaker channel corresponding to, and indicative of content to be played by, a different speaker of a set of playback speakers);

a "weighing" step (72), which includes generating watermarking suitability data indicative of suitability for watermarking of each of the playback speaker channels;

a step (73) of selecting a subset of the playback speaker channels of the segment using the watermarking suitability data, and watermarking each channel of the subset of the playback speaker channels of the segment; and a step (74) of synchronizing the watermarked audio content of each watermarked channel of the subset of the playback speaker channels of the segment and the non-watermarked audio content of each other channel of the subset of the playback speaker channels of the segment.

In some embodiments in the second class, the playback system uses the configuration of the playback speakers (installed in an auditorium or other playback environment) to select the subset of channels to be watermarked, including by identifying groups (subsets) of the full set of playback speakers in distinct locations (zones) in the playback environment. These embodiments includes steps of: determining from channels of the program a set of playback speaker channels, each for playback by a different one of the playback speakers (each speaker may comprise one or more transducers), selecting a subset of the set of playback speaker channels for watermarking, and watermarking each channel in the subset of the set of playback speaker channels (thereby generating a set of watermarked channels), including by identifying groups of the playback speakers which are installed in distinct zones in the playback environment such that each of the groups consists of speakers installed in a different one of the zones, identifying suitability for watermarking of audio content for playback by each of the groups, and selecting the subset of the set of playback speaker channels in accordance with the suitability for watermarking of audio content for playback by each of at least a subset of the groups. Typically, the audio content (e.g., object channel content and speaker channel content) of the program (or a segment of the program) is rendered, thereby determining the set of playback speaker channels (each playback speaker channel corresponding to, and indicative of content to be played by, a different speaker of the set of playback speakers), and the playback system selects one playback speaker channel (or a small number of playback speaker channels) corresponding to each of the groups of speakers (e.g., a speaker channel for driving one speaker in each of the groups) or each of a subset of the groups, and watermarks each such selected playback speaker channel. This can result in watermarking of only channels that typically indicate audio content of specific type(s), and can enable recovery (with a high probability of success) of the watermarks without incurring large computation costs. These embodiments do not measure the loudness (or another characteristic) of the audio content of each channel selected for watermarking. Instead, they assume that some playback speaker channels (of a full set of playback speaker channels) are suitable for watermarking (e.g., are likely to be indicative of loud content, and/or content of specific type(s)) and should be watermarked. Typically, only playback speaker channels that are assumed to be likely to be suitable for watermarking are watermarked, and a signal for driving a speaker from each group of the full set of speakers is watermarked. An example of such an embodiment in the second class will be described with reference to FIG. 5.

Figure 5:
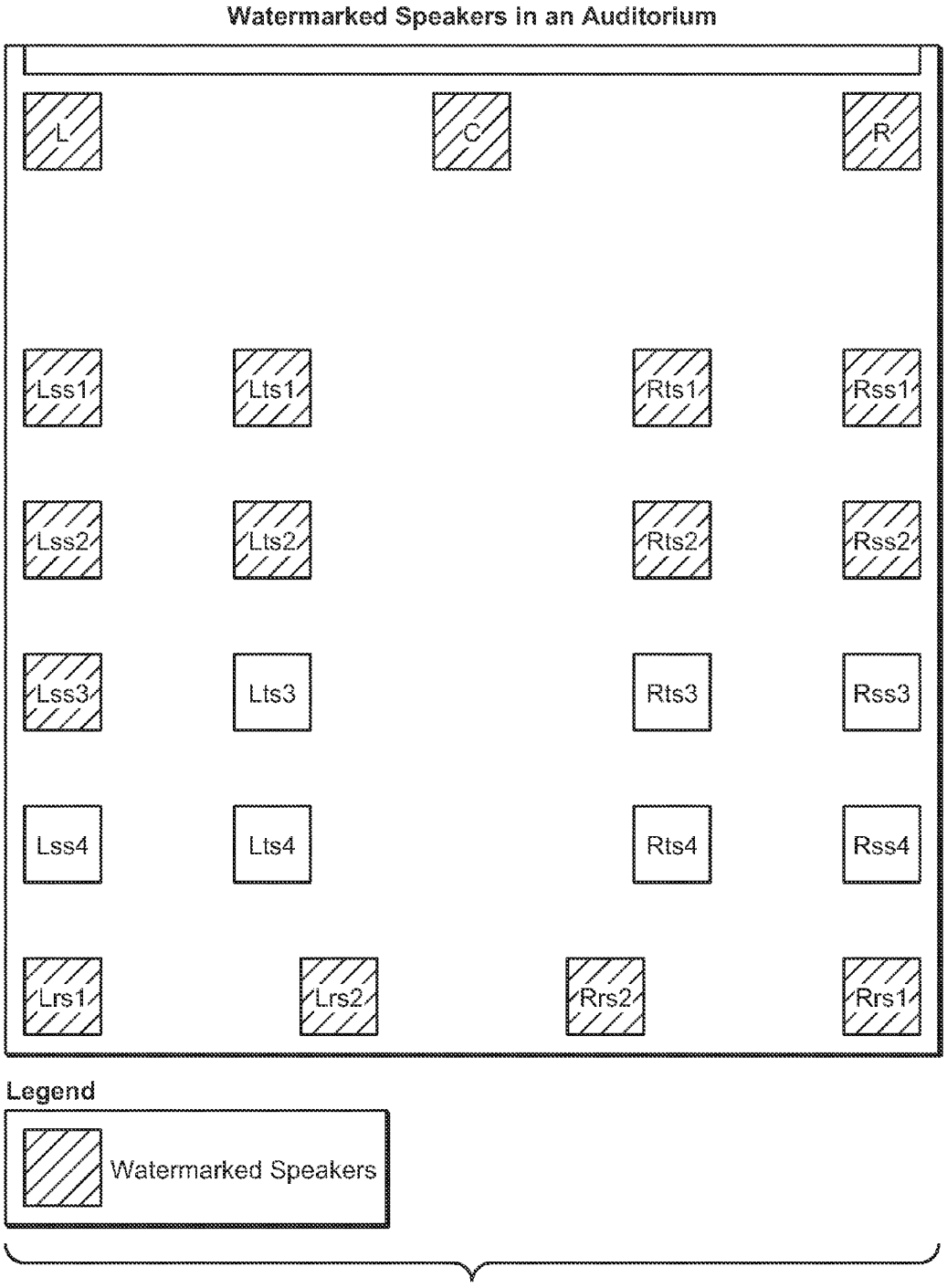
FIG. 5 is a diagram of an array of speakers, some of which may be driven by watermarked signals generated in accordance with an embodiment of the inventive method.

FIG. 5 shows an array of playback speakers in a room (e.g., a movie theater). The speakers are grouped into the following groups: front left speaker (L), front center speaker (C), front right speaker (R), left side speakers (Lss1, Lss2, Lss3, and Lss4), right side speakers (Rss1, Rss2, Rss3, and Rss4), left ceiling-mounted speakers (Lts1, Lts2, Lts3, and Lts4), right ceiling-mounted speakers (Rts1, Rts2, Rts3, and Rts4), left rear (surround) speakers (Lrs1 and Lrs2), and right rear (surround) speakers (Rrs1 and Rrs2).

The content to be played by the front left speaker (L), front center speaker (C), front right speaker (R), left rear speakers (Lrs1 and Lrs2), and right rear speakers (Rrs1 and Rrs2) is assumed to be suitable for watermarking, and thus the playback speaker channel corresponding to each of these speakers is watermarked (e.g., by an implementation of subsystem 11 of decoder 7). The content to be played by the left side speakers (Lss1, Lss2, Lss3, and Lss4) and right side speakers (Rss1, Rss2, Rss3, and Rss4) is assumed to be less suitable for watermarking, and thus the playback speaker channels corresponding to only two or three speakers in each of these two groups (i.e., Lss1, Lss2, Lss3, Rss1, and Rss2, as indicated in FIG. 5) is watermarked (e.g., by an implementation of subsystem 11 of decoder 7). The content to be played by the left ceiling-mounted speakers (Lts1, Lts2, Lts3, and Lts4) and right ceiling-mounted speakers (Rts1, Rts2, Rts3, and Rts4) is also assumed to be less suitable for watermarking, and thus the playback speaker channels corresponding to only two speakers in each of these two groups (i.e., Lts1, Lts2, Rts1, and Rts2, as indicated in FIG. 5) is watermarked (e.g., by an implementation of subsystem 11 of decoder 7).

If it is predetermined that only a maximum number ("M") of playback speaker channels will be marked (e.g., M=16 as in FIG. 5), although rendering of a program will generate playback speaker channels for driving more than "M" playback speakers (e.g., 23 playback speaker channels for driving 23 playback speakers as in FIG. 5), the specific playback speaker channels to be watermarked may be selected as follows: one playback speaker channel for each group of speakers is selected (e.g., L, C, R, Lss1, Lrs1, Rss1, Rrs1, Lts1, and Rts1 as in FIG. 5) is selected for watermarking; then an additional playback speaker channel from each group is selected for watermarking (e.g., Lss2, Lrs2, Rss2, Rrs2, Lts2, and Rts2, as in FIG. 5) so long as the total number of channels to be watermarked does not exceed "M" (or until the total number of channels to be watermarked reaches "M); and so on. Thus, in the FIG. 5 example, a third playback speaker channel (Lss3) from one group is selected for watermarking which brings the total number of channels to be watermarked to "M" (i.e., M=16 in the FIG. 5 example). Typically, the selection of the speaker channels to be marked is done once for a playback environment (e.g., an auditorium) and this selection does not change (it stays static) regardless of the content played in the environment.

Depending on the employed watermarking technology, watermarking can often be formulated as an additive process in which a watermark signal is added to an audio signal. The watermark signal is adjusted in terms of level and spectral properties according to the host (audio) signal. As such, the watermark can easily be faded out on one stream (channel) and faded in on another stream (channel) without creating artifacts, provided that a sufficient fade duration (typically about 10 ms or longer) is used. Thus, selection of a subset of a full set of channels for watermarking may typically be performed with a temporal granularity of on the order of tens of milliseconds (i.e., a selection is performed for each segment of the program having duration of on the order of tens of milliseconds), although it may be beneficial to perform it less frequently (i.e., to perform a selection for each segment of the program having duration of more than on the order of tens of milliseconds).

Content creation systems (e.g., in movie studios) typically can enable or disable audio watermarking during the content authoring process. By dynamically modify watermarking properties during content creation (i.e., by dynamically selecting different subsets of channels of content to be watermarked), the mixing engineer may influence the watermarking process to ensure that critical excerpts in the content are or are not watermarked (or are subject to watermarking which is more or less perceptible).

Embodiments of the invention may be implemented in hardware, firmware, or software, or a combination thereof (e.g., as a programmable logic array). For example, encoder 3, or decoder 7, or subsystem 8, 9, and/or 11 of decoder 7 of FIG. 1 may be implemented in appropriately programmed (or otherwise configured) hardware or firmware, e.g., as a programmed general purpose processor, digital signal processor, or microprocessor. Unless otherwise specified, the algorithms or processes included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems (e.g., a computer system which implements encoder 3, or decoder 7, or subsystem 8, 9, and/or 11 of decoder 7 of FIG. 1), each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

For example, when implemented by computer software instruction sequences, various functions and steps of embodiments of the invention may be implemented by multithreaded software instruction sequences running in suitable digital signal processing hardware, in which case the various devices, steps, and functions of the embodiments may correspond to portions of the software instructions.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be implemented as a computer-readable storage medium, configured with (i.e., storing) a computer program, where the storage medium so configured causes a computer system to operate in a specific and predefined manner to perform the functions described herein.

While implementations have been described by way of example and in terms of exemplary specific embodiments, it is to be understood that implementations of the invention are not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method for watermarking a multichannel audio program, including the steps of:

(a) in response to an ordered list, selecting a subset of channels of at least a segment of the program for watermarking, such that the selection of the subset is based on the program or on configuration of playback speakers to be employed for playback of the program, wherein the ordered list indicates the channels in order of suitability for watermarking, a part of the ordered list indicates a first set of the channels which are required to be watermarked, and a second part of the ordered list indicates each of the channels which is not in the first set; and (b) watermarking each channel in the subset of channels, thereby generating a set of watermarked channels; and (c) analyzing audio content in a segment of the program to determine values indicative of suitability for watermarking of audio content of channels of the program in the segment, and determining the second part of the ordered list in response to the values, wherein step (a) includes a step of selecting the subset of channels in response to said values, and wherein step (c) includes:

a step of determining root mean square amplitude of the audio content of each of the channels in the segment, or a step of determining energy or root mean square amplitude of the audio content in a limited frequency range of each of the channels in the segment.

2. The method of claim 1, also including steps of:

determining from channels of the program a set of playback speaker channels, each for playback by a different speaker of a set of speakers installed in a playback environment, where the subset of channels of the program selected in step (a) is a subset of the set of playback speaker channels, and step (a) includes steps of:

identifying groups of the speakers which are installed in distinct zones in the playback environment such that each of the groups consists of speakers installed in a different one of the zones, and identifying watermarking suitability of audio content for playback by each of the groups; and selecting the subset of the set of playback speaker channels in accordance with the watermarking suitability of audio content for playback by each of at least a subset of the groups.

3. The method of claim 1, also including a step of:

after steps (a) and (b), generating speaker feeds in response to the set of watermarked channels and at least one unwatermarked channel of the program.

4. The method of claim 1, wherein the program includes a set of channels, said method also including a step of:

rendering the program including by generating speaker feeds in response to at least some of the channels of the program, and wherein step (a) includes a step of selecting a subset of the speaker feeds for watermarking, and step (b) includes a step of watermarking at least a segment of each speaker feed in the subset of speaker feeds.

5. The method of claim 1, wherein the program is an object-based audio program, and said method includes a step of:

determining a set of playback speaker channels, each for playback by a different speaker of a playback system, from at least one object channel and/or at least one speaker channel of the program, and wherein the subset of channels selected in step (a) is a subset of the set of playback speaker channels.

6. The method of claim 1, wherein the program includes watermarking metadata, said method includes a step of operating a decoder to decode and render the program, and step (a) includes a step of selecting the subset of channels using the watermarking metadata.

7. The method of claim 6, wherein the watermarking metadata are watermark suitability values, each of the watermark suitability values of a segment of the program is indicative of suitability for watermarking of audio content of a corresponding channel of the program in the segment.

8. The method of claim 1, also including a step of:

wherein the watermarking suitability value for at least one channel of the segment is at least partially determined from a number of speakers to be driven to emit content indicative of the channel during playback of the segment.

9. An audio playback system, including:

a decoding subsystem, coupled and configured to parse and decode an encoded bitstream to extract therefrom audio data and metadata indicative of a multichannel audio program; and a second subsystem, coupled and configured to select, in response to an ordered list, a subset of channels of at least a segment of the program for watermarking, and to watermark data indicative of each channel in the subset of channels thereby determining a set of watermarked channels, wherein the selection of the subset is based on the program or on configuration of playback speakers to be employed for playback of the program, wherein the ordered list indicates the channels in order of suitability for watermarking, a part of the ordered list indicates a first set of the channels which are required to be watermarked, and a second part of the ordered list indicates each of the channels which is not in the first set, wherein the second subsystem is configured to analyze the audio data of a segment of the program to determine values indicative of watermarking suitability of audio content of channels of the program in the segment, including by determining root mean square amplitude of the audio data of each of the channels in the segment or by determining energy or root mean square amplitude of the audio data in a limited frequency range of each of the channels in the segment, and to determine the second part of the ordered list and select the subset of channels in response to said values.

10. The system of claim 9, wherein the second subsystem is configured to determine from the audio data and the metadata a set of playback speaker channels, each for playback by a different speaker of a set of speakers installed in a playback environment, and to select a subset of the set of playback speaker channels as the subset of channels, including by:

identifying groups of the speakers which are installed in distinct zones in the playback environment such that each of the groups consists of speakers installed in a different one of the zones, and identifying watermarking suitability of audio content for playback by each of the groups; and selecting the subset of the set of playback speaker channels in accordance with the watermarking suitability of audio content for playback by each of at least a subset of the groups.

11. The system of claim 9, wherein the program includes a set of channels, and the second subsystem is configured:

to render the program including by generating speaker feeds in response to at least some of the channels of the program; and to select a subset of the speaker feeds for watermarking and watermark at least a segment of each speaker feed in the subset of speaker feeds.

12. The system of claim 9, wherein the program is an object-based audio program, the second subsystem is configured to determine a set of playback speaker channels, each for playback by a different speaker of a playback system, from at least one object channel and/or at least one speaker channel of the program, and to select a subset of the set of playback speaker channels as the subset of channels.

13. The system of claim 9, wherein the program includes watermarking metadata, the decoding subsystem is configured to extract the watermarking metadata, and the second subsystem is configured to use the watermarking metadata to select the subset of channels for watermarking.

14. The system of claim 13, wherein the watermarking metadata are watermark suitability values, each of the watermark suitability values of a segment of the program is indicative of suitability for watermarking of audio content of a corresponding channel of the program in the segment.

15. The system of claim 9, wherein the watermarking suitability value for at least one channel of the segment is at least partially determined from a number of speakers to be driven to emit content indicative of the channel during playback of the segment.

16. An audio encoder configured to generate a bitstream indicative of an encoded multichannel audio program, said encoder including:

a first subsystem coupled and configured to generate watermarking metadata indicative of an ordered list in response to segments of streams of audio content, wherein the watermarking metadata is indicative of suitability for watermarking of at least one segment of each of the streams, or the watermarking metadata is indicative of whether watermarking should be performed on at least one segment of each of the streams, wherein the ordered list indicates the channels of at least one segment of each of the streams in order of suitability for watermarking, a part of the ordered list indicates a first set of the channels which are required to be watermarked, and a second part of the ordered list indicates each of the channels which is not in the first set; and a second subsystem coupled and configured to generate the bitstream indicative of the encoded multichannel audio program, including by encoding at least some of the streams of audio content to generate encoded streams of audio content, and including in the bitstream each of the encoded streams of audio content, each of the streams of audio content which is not encoded, and the watermarking metadata, wherein the first subsystem is configured to analyze at least one segment of each of the streams of audio content to determine values indicative of watermarking suitability of audio content of each of the streams in the segment, including by determining root mean square amplitude of the audio content of said each of the streams in the segment or by determining energy or root mean square amplitude of the audio content in a limited frequency range of each of the channels in the segment, and to determine the second part of the ordered list in response to said values.

17. The encoder of claim 16, wherein the watermarking suitability value for at least one channel of the segment is at least partially determined from a number of speakers to be driven to emit content indicative of the channel during playback of the segment.

18. The system of claim 9, wherein the second subsystem is further configured to generate speaker feeds in response to the set of watermarked channels and at least one unwatermarked channel of the program.

19. A non-transitory computer readable storage medium comprising a sequence of instructions, wherein, when executed by one or more subsystems of an audio playback system, the sequence of instructions causes the audio playback system to perform the method of claim 1.

20. The method of claim 1, wherein step (a) includes a step of selecting, for watermarking, at least one of the channels which is not in the first set in response to the ordered list.

* * * * *